US011308864B1

(12) United States Patent
Liao et al.

(10) Patent No.: US 11,308,864 B1
(45) Date of Patent: Apr. 19, 2022

(54) MICRO LIGHT-EMITTING DIODE DISPLAY DEVICE AND SUB-PIXEL CIRCUIT THEREOF

(71) Applicant: PlayNitride Display Co., Ltd., Zhunan Township, Miaoli County (TW)

(72) Inventors: Kuan-Yung Liao, Zhunan Township, Miaoli County (TW); I-Chung Chiu, Zhunan Township, Miaoli County (TW)

(73) Assignee: PLAYNIIRTDE DISPLAY CO., LTD., Zhunan Township, Miaoli County (TW)

( * ) Notice: Subject to any disclaimer, the term of this patent is extended or adjusted under 35 U.S.C. 154(b) by 0 days.

(21) Appl. No.: 17/241,940

(22) Filed: Apr. 27, 2021

(30) Foreign Application Priority Data

Dec. 15, 2020 (TW) ..... 109144349

(51) Int. Cl.
*G09G 3/32* (2016.01)

(52) U.S. Cl.
CPC ..... *G09G 3/32* (2013.01); *G09G 2300/0814* (2013.01); *G09G 2310/0267* (2013.01); *G09G 2310/0275* (2013.01); *G09G 2320/04* (2013.01)

(58) Field of Classification Search
CPC ..... G09G 3/32; G09G 2300/0814; G09G 2310/0267; G09G 2310/0275; G09G 2320/04
See application file for complete search history.

(56) References Cited

U.S. PATENT DOCUMENTS

2006/0238135 A1* 10/2006 Kimura ..... G09G 3/20 315/169.3
2017/0186782 A1* 6/2017 Lee ..... H01L 27/1225
2017/0200412 A1* 7/2017 Gu ..... G09G 3/3266
2018/0226019 A1* 8/2018 Tong ..... G09G 3/3291
2018/0357964 A1* 12/2018 Shin ..... H01L 27/3265
2019/0114020 A1* 4/2019 Ding ..... G06F 3/042
2019/0244559 A1* 8/2019 Cho ..... G09G 3/3208
2019/0272781 A1* 9/2019 Touvet ..... G09G 3/16
2019/0327798 A1* 10/2019 Kao ..... H05B 45/48
2019/0335553 A1* 10/2019 Ahmed ..... G02B 3/0018
2020/0035183 A1* 1/2020 Hou ..... G09G 3/3674
2021/0210016 A1* 7/2021 Li ..... G09G 3/3266
2021/0225278 A1* 7/2021 Ling ..... G09G 3/3291

FOREIGN PATENT DOCUMENTS

TW I537919 B 6/2016
TW I641126 B 11/2018

* cited by examiner

*Primary Examiner* — Jose R Soto Lopez
(74) *Attorney, Agent, or Firm* — Muncy, Geissler, Olds & Lowe, P.C.

(57) ABSTRACT

A micro light-emitting diode display device and a sub-pixel circuit thereof are provided. The sub-pixel circuit includes a switch unit, a selection driving unit and a light-emitting unit. The switch unit receives a data signal. The selection driving unit is electrically connected to the switch unit, and electrically connected to a first voltage. The light-emitting unit includes two micro light-emitting diodes, which are electrically connected to the selection driving unit. The first ends of the micro light-emitting diodes are connected to the selection driving unit. The second ends of the micro light-emitting diodes are electrically connected to a second voltage. The selection driving unit selects one of the micro light-emitting diodes to emit light according to the data signal transmitted through the switch unit.

17 Claims, 5 Drawing Sheets

MICRO LIGHT-EMITTING DIODE DISPLAY DEVICE AND SUB-PIXEL CIRCUIT THEREOF

CROSS REFERENCE TO RELATED APPLICATIONS

This Non-provisional application claims priority under 35 U.S.C. § 119(a) on Patent Application No(s). 109144349 filed in Taiwan, Republic of China on Dec. 15, 2020, the entire contents of which are hereby incorporated by reference.

BACKGROUND

Technology Field

The present disclosure relates to a sub-pixel circuit and, in particular, to a micro light-emitting diode (LED) display device and a sub-pixel circuit thereof.

Description of Related Art

When the world is paying attention to future display technologies, the micro LED is one of the most promising technologies. In brief, the micro LED is a technology combining miniaturizing and re-arranging of LEDs, thereby placing millions or even tens of millions of dies, which are smaller than 100 microns and thinner than a hair, on a substrate. Compared with the current OLED (organic LED) display technology, the micro LED is also self-luminous, but it does not have the most deadly "screen burn-in" problem of OLED due to the different materials used. In addition, the micro LED further has the advantages of low power consumption, high contrast, wide color gamut, high brightness, small size, thin, light weight, energy saving, etc. Therefore, major manufacturers around the world are scrambling to invest in the research and development of micro LED technology.

In the micro LED display device, since the micro LEDs of each sub-pixel have very small dimensions, the driving circuits thereof are correspondingly very fine. When the micro LEDs of some sub-pixels are abnormal (damaged or malfunctioned) to affect the brightness, the conventional repair technology is to modify the circuits of the abnormal sub-pixels in the post-process, such as the process of cutting the redundant circuits by laser, or the process of establishing new connection after an insulation step. However, for all of the conventional post-processes, the repairing of the sub-pixel circuits of the micro LED display device is very difficult, and it is not beneficial to the mass production.

SUMMARY

In view of the foregoing, this disclosure is to provide a micro LED display device and a sub-pixel circuit thereof, which can repair the micro LEDs of the abnormal sub-pixels without utilizing the convention post-process to modify the sub-pixel circuits.

To achieve the above, a sub-pixel circuit of a micro LED display device of this disclosure comprises a switch unit, a selection driving unit, and a light-emitting unit. The switch unit receives a data signal. The selection driving unit is electrically connected to the switch unit, and the selection driving unit is further electrically connected to a first voltage. The light-emitting unit comprises two micro LEDs. The two micro LEDs are electrically connected to the selection driving unit individually. Each LED comprises a first end and a second end. The first ends of the micro LEDs are electrically connected to the selection driving unit, and the second ends of the micro LEDs are electrically connected to a second voltage. The selection driving unit selects one of the micro LEDs to emit light according to the data signal transmitted through the switch unit.

To achieve the above, a micro LED display device of this disclosure comprises a display panel, and the display panel comprises a plurality of sub-pixels. The sub-pixels are arranged in an array including rows and columns, and each of the sub-pixels comprises a sub-pixel circuit. The sub-pixel circuit comprises a switch unit, a selection driving unit and a light-emitting unit. The switch unit receives a data signal. The selection driving unit is electrically connected to the switch unit, and the selection driving unit is further electrically connected to a first voltage. The light-emitting unit comprising two micro LEDs, which are electrically connected to the selection driving unit individually. Each of the LEDs comprises a first end and a second end. The first ends of the micro LEDs are electrically connected to the selection driving unit, and the second ends of the micro LEDs are electrically connected to a second voltage. The selection driving unit selects one of the micro LEDs to emit light according to the data signal transmitted through the switch unit.

In one embodiment, the selection driving unit comprises two driving transistors, which are disposed corresponding to and connected to the micro LEDs, respectively. The selection driving unit selects to conduct one of the driving transistor according to the data signal so as to drive the micro LED connected to the conducted driving transistor to emit light.

In one embodiment, the two driving transistors of the selection driving unit comprises a P-type transistor and an N-type transistor.

In one embodiment, each of the driving transistors comprises a control end, a first end and a second end. The control ends of the driving transistors are connected to each other and electrically connected to the switch unit, the first ends of the driving transistors are electrically connected to the first voltage, and the second ends of the driving transistors are electrically connected to the first ends of the micro LEDs, respectively.

In one embodiment, the switch unit comprises a switch transistor, wherein a control end of the switch transistor is connected to a scan line for receiving a scan signal, a first end of the switch transistor is connected to a data line for receiving the data signal, and a second end of the switch transistor is connected to the control ends of the driving transistors.

In one embodiment, the sub-pixel circuit further comprises a reset unit, which comprises at least a reset transistor. A first end of the reset transistor is connected to the control ends of the driving transistors, and a second end of the reset transistor is electrically connected to a reset voltage.

In one embodiment, the sub-pixel circuit further comprises an enable unit, which comprises a first enable transistor and a second enable transistor. Each of the first enable transistor and the second enable transistor comprises a control end, a first end and a second end. The control ends of the first enable transistor and the second enable transistor are connected to each other and receive an enable signal. The first end of the first enable transistor is electrically connected to the first voltage, and the second end of the first enable transistor is connected to the first ends of the driving transistors. The first end of the second enable transistor is connected to the second ends of the micro LEDs, and the second end of the second enable transistor is electrically connected to the second voltage.

In one embodiment, when the enable signal conducts the first enable transistor and the second enable transistor, the micro LED connected to the conducted driving transistor emits light.

As mentioned above, in the micro LED display device and the sub-pixel circuit thereof of this disclosure, the selection driving unit is electrically connected to the first voltage, the first ends of two micro LEDs of the light-emitting unit are connected to the selection driving unit, the second ends of the micro LEDs are electrically connected to the second voltage, and the selection driving unit selects one of the micro LEDs to emit light according to the data signal transmitted through the switch unit. Based on the circuit design of this disclosure, the micro LEDs of the abnormal sub-pixels can be repaired without utilizing the convention post-process to modify the sub-pixel circuits.

BRIEF DESCRIPTION OF THE DRAWINGS

The disclosure will become more fully understood from the detailed description and accompanying drawings, which are given for illustration only, and thus are not limitative of the present disclosure, and wherein.

DETAILED DESCRIPTION OF THE DISCLOSURE

The present disclosure will be apparent from the following detailed description, which proceeds with reference to the accompanying drawings, wherein the same references relate to the same elements.

To be noted, if the micro LED display device is a monochromatic display device, each "sub-pixel circuit" of this disclosure can be one "pixel circuit"; if the micro LED display device is a color display device, three or more "sub-pixel circuits" of this disclosure can be together form one "pixel circuit".

Figure 1:
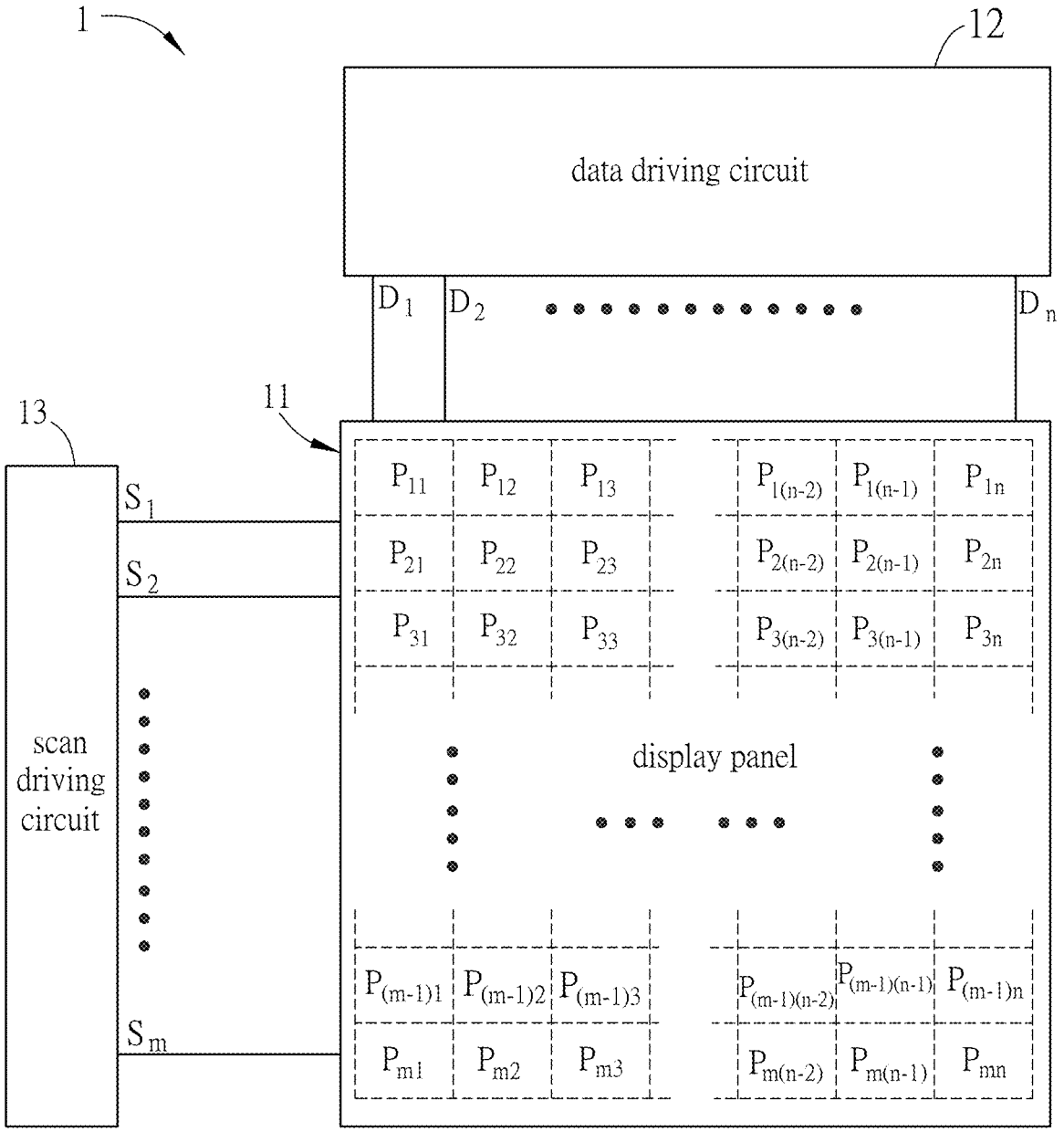
FIG. 1 is a schematic diagram showing a micro LED display device according to an embodiment of this disclosure.

FIG. 1 is a schematic diagram showing a micro LED display device according to an embodiment of this disclosure. As shown in FIG. 1, the micro LED display device 1 is an active matrix (AM) micro LED display device and comprises a display panel 11, a data driving circuit 12, and a scan driving circuit 13.

The display panel 11 is a micro LED display panel. When the micro LEDs of the display panel 11 are driven or turned on, the display panel 11 can display an image. The display panel 11 comprises a plurality of sub-pixels $P_{11}$~$P_{mn}$, which are arranged in an array (rows and columns). In this embodiment, each of the sub-pixels $P_{11}$~$P_{mn}$ comprises a sub-pixel circuit (see FIG. 2A or 3A).

The data driving circuit 12 is disposed adjacent to the display panel 11 and is electrically connected to the display panel 11. In this embodiment, the micro LED display device 1 further comprises a plurality of data lines $D_1$~$D_n$, and the data driving circuit 12 is electrically connected to the display panel 11 through the data lines $D_1$~$D_n$. Accordingly, the data driving circuit 12 can output a data signal to the sub-pixels $P_{11}$~$P_{mn}$ of the display panel 11 through the data lines $D_1$~$D_n$. In addition, the data driving circuit 12 can further output a first voltage $V_{DD}$ and a second voltage $V_{EE}$ (see FIG. 2A) to the sub-pixels $P_{11}$~$P_{mn}$ of the display panel 11 individually. Specifically, the first voltage $V_{DD}$ and the second voltage $V_{EE}$ can be provided by the data driving circuit 12. In practice, the first voltage $V_{DD}$ is a DC driving voltage for driving the light-emitting elements (i.e. micro LEDs) of the sub-pixels $P_{11}$~$P_{mn}$ to emit light, and the second voltage $V_{EE}$ is the common voltage of the sub-pixels $P_{11}$~$P_{mn}$. Herein, the first voltage $V_{DD}$ is greater than the second voltage $V_{EE}$. In some embodiments, for example, the first voltage $V_{DD}$ is 4.6V, and the second voltage $V_{EE}$ is −2V. This disclosure is not limited thereto. In other embodiments, different first voltage $V_{DD}$ and second voltage $V_{EE}$ can be provided based on the characteristics of the micro LEDs to be driven.

In addition, the micro LED display device 1 can further comprise a plurality of scan lines $S_1$~$S_m$, which are disposed adjacent to the display panel 11. The scan driving circuit 13 is electrically connected to the display panel 11 through the scan lines $S_1$~$S_m$. Accordingly, the scan driving circuit 13 can sequentially output a scan signal to rows of the sub-pixels through the scan lines $S_1$~$S_m$.

In the micro LED display device 1 of this embodiment, when the scan driving circuit 13 outputs the scan signal through the scan lines $S_1$~$S_m$ to sequentially conduct the rows of sub-pixels, the data driving circuit 12 can transmit the corresponding data signals to the sub-pixels $P_{11}$~$P_{mn}$ through the data lines $D_1$~$D_n$. In addition, the data driving circuit 12 can also output the first voltage $V_{DD}$ and the second voltage $V_{EE}$ to the sub-pixels $P_{11}$~$P_{mn}$ of the display panel 11, thereby driving or turning on the micro LEDs of the sub-pixels $P_{11}$~$P_{mn}$ so as to enable the display device 1 to display an image.

The process for repairing the micro LED of the abnormal sub-pixel in the micro LED display device of the above embodiment will be described in detail with reference to FIGS. 2A to 2E. Wherein, FIG. 2A is a schematic diagram showing the circuit of one sub-pixel in the micro LED display device of FIG. 1, FIG. 2B is a schematic graph showing the waveforms of the scan signal and the data signal in the micro LED display device of FIG. 1, FIG. 2C is a schematic diagram showing the turned-on micro LEDs corresponding to the scan signal and data signal of FIG. 2B, FIG. 2D is a schematic graph showing the waveforms of the scan signal and the data signal when the micro LED of the sub-pixel in the micro LED display device of FIG. 1 is found abnormal, and FIG. 2E is a schematic diagram showing the turned-on micro LEDs corresponding to the scan signal and data signal of FIG. 2D.

Figure 2A:
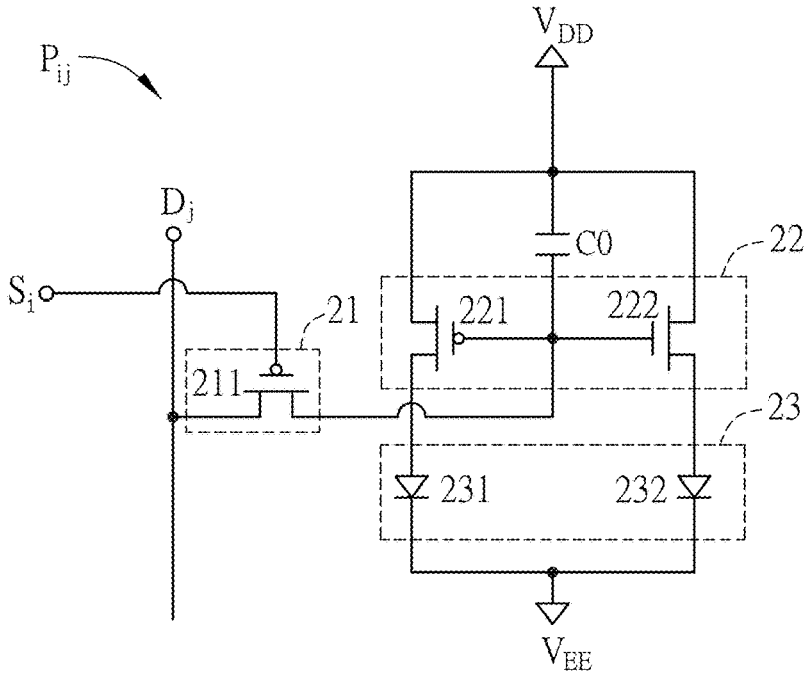
FIG. 2A is a schematic diagram showing the circuit of one sub-pixel in the micro LED display device of FIG. 1.
Figure 2B:
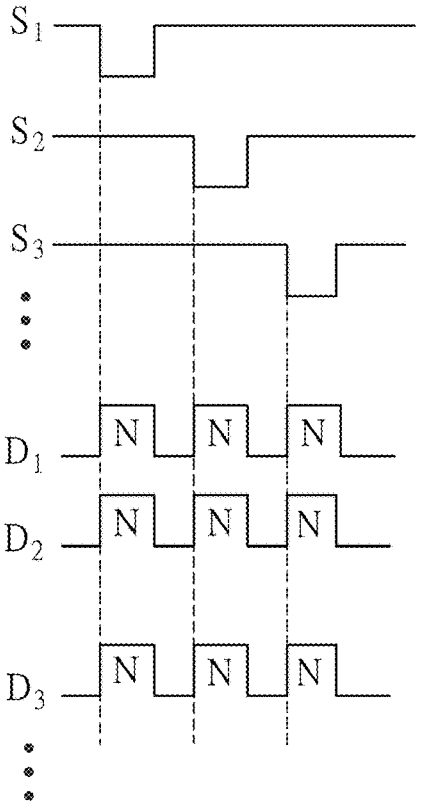
FIG. 2B is a schematic graph showing the waveforms of the scan signal and the data signal in the micro LED display device of FIG. 1.
Figure 2C:
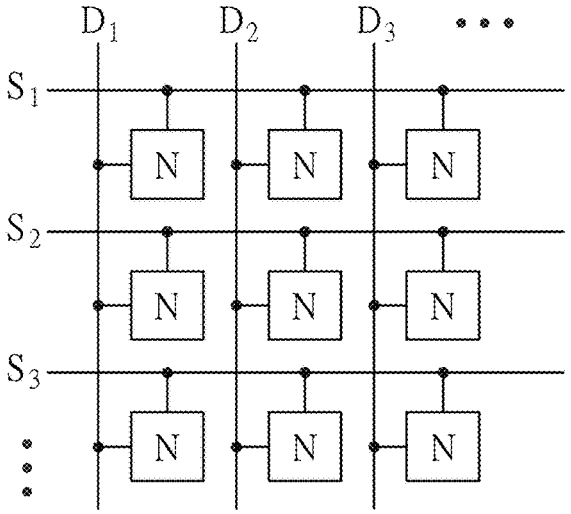
FIG. 2C is a schematic diagram showing the turned-on micro LEDs corresponding to the scan signal and data signal of FIG. 2B.
Figure 2D:
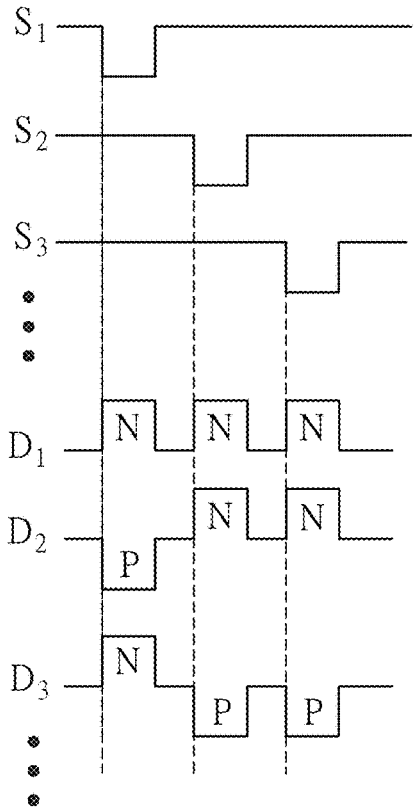
FIG. 2D is a schematic graph showing the waveforms of the scan signal and the data signal when the micro LED of the sub-pixel in the micro LED display device of FIG. 1 is found abnormal.
Figure 2E:
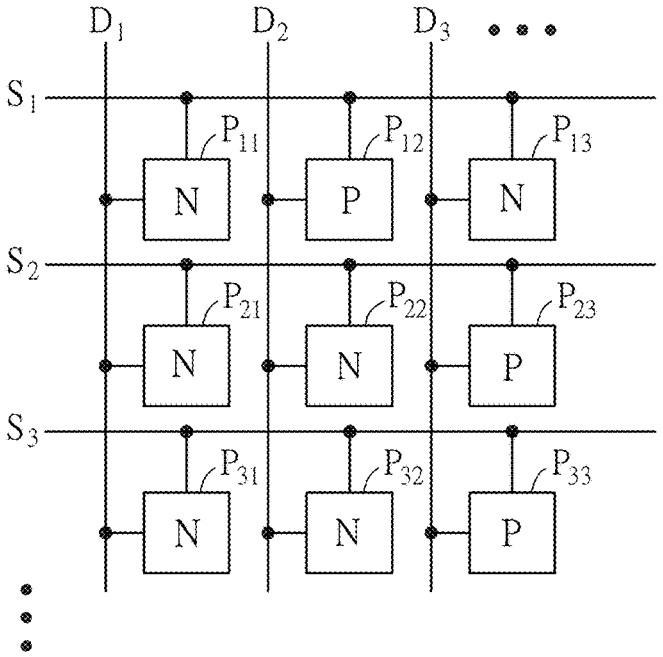
FIG. 2E is a schematic diagram showing the turned-on micro LEDs corresponding to the scan signal and data signal of FIG. 2D.

To be noted, the reference numbers $S_1$, $S_2$ and $S_3$ shown in FIGS. 2A to 2E can represent the scan lines or the scan signals, and the reference numbers $D_1$, $D_2$ and $D_3$ shown in FIGS. 2A to 2E can represent the data lines or the data signals. For example, the reference numbers $S_1$, $S_2$ and $S_3$ in FIGS. 2C and 2E represent the scan lines, but the reference numbers $S_i$, $S_1$, $S_2$ and $S_3$ in FIGS. 2A, 2B and 2D represent the scan signals. In addition, the reference numbers $D_1$, $D_2$ and $D_3$ in FIGS. 2C and 2E represent the data lines, but the reference numbers $D_j$, $D_1$, $D_2$ and $D_3$ in FIGS. 2B and 2D represent the data signals. The definitions thereof depend on the actual situations. Besides, as shown in FIGS. 2B and 2D, "N" indicates that the selection driving unit of the sub-pixel selects to conduct the N-type transistor, and "P" indicates that the selection driving unit of the sub-pixel selects to conduct the P-type transistor. As shown in FIGS. 2C and 2E, "N" indicates that the micro LED corresponding to the N-type transistor of the selection driving unit of the sub-pixel is turned on, and "P" indicates that the micro LED corresponding to the P-type transistor of the selection driving unit of the sub-pixel is turned on. To be noted, as described in this disclosure, the "control end" of the transistor can be the gate of the transistor, the "first end" of the transistor can be a first source/drain of the transistor, and the "second end" of the transistor can be a second source/drain of the transistor.

As shown in FIG. 2A, in this embodiment, the sub-pixel $P_{ij}$ (showing a sub-pixel circuit) comprises a switch unit 21, a selection driving unit 22, and a light-emitting unit 23. In addition, the sub-pixel $P_{ij}$ (sub-pixel circuit) further comprises a capacitor C0. Herein, "i" can be between 1 and m ($1 \le i \le m$), and "j" can be between 1 and n ($1 \le j \le n$). In addition, the sub-pixels $P_{ij}$ of FIG. 2A can be based on, for example, a 2T1C circuit structure, but this disclosure is not limited thereto. In other embodiments, each sub-pixels $P_{ij}$ (sub-pixel circuit) can have any of other circuit structures, such based on a 6T2C circuit structure (see FIG. 3A), or any of other circuit structures.

The switch unit 21 can be controlled and conducted by a scan signal $S_i$ for receiving a data signal $D_j$. In this embodiment, the switch unit 21 comprises a switch transistor 211, wherein a control end of the switch transistor 211 is connected to a scan line for receiving a scan signal $S_i$, a first end of the switch transistor 211 is connected to a data line for receiving the data signal $D_j$, and a second end of the switch transistor 211 is electrically connected to the selection driving unit 22. In this embodiment, the switch transistor 211 is an P-type transistor, such as, for example but not limited to, a MOSFET. Those skilled in the art should understand that the switch transistor 211 can also be a N-type transistor.

The selection driving unit 22 is electrically connected to the switch unit 21, and the selection driving unit 22 is further electrically connected to the first voltage $V_{DD}$. In this embodiment, the selection driving unit 22 comprises two driving transistors 221 and 222, which are electrically connected to the switch unit 21 individually, and are further electrically connected to the first voltage $V_{DD}$. The driving transistor 221 or 222 is functioned as the driving element of the light-emitting unit 23, and each of the driving transistors 221 and 222 has a control end, a first end and a second end. The control ends of the driving transistors 221 and 222 are connected to each other, and connected to the second end of the switch transistor 211. The control ends of the driving transistors 221 and 222 are connected to the first voltage $V_{DD}$ through the capacitor C0, the first ends of the driving transistors 221 and 222 are electrically connected to the first voltage $V_{DD}$, and the second ends of the driving transistors 221 and 222 are connected to the corresponding light-emitting units 23. In this embodiment, the driving transistor 221 is a P-type transistor, and the driving transistor 222 is an N-type transistor. Of course, in other embodiments, the driving transistor 221 can be an N-type transistor, and the driving transistor 222 can be a P-type transistor. Since the control ends of the P-type driving transistor 221 and the N-type driving transistor 222 are both connected to the second end of the switch transistor 211, and only one of the driving transistors 221, 222 will be turned on by data signal $D_j$. It means that the N-type driving transistor 222 will be not turned on when the P-type driving transistor 221 is conducted due to negative bias of the data signal $D_j$. Otherwise, the P-type driving transistor 221 will be not turned on when the P-type driving transistor 222 is conducted due to positive bias of the data signal $D_j$.

The light-emitting unit 23 comprises two micro LEDs 231 and 232, and each of the micro LEDs 231 and 232 is electrically connected to the selection driving unit 22. In this embodiment, the driving transistors 221 and 222 of the selection driving unit 22 are disposed corresponding to the micro LEDs 231 and 232, respectively. Each of the micro LEDs 231 and 232 has a first end and a second end. The first ends of the micro LEDs 231 and 232 are disposed corresponding to and connected to the driving transistors 221 and 222 of the selection driving unit 22, respectively, and the second ends thereof are electrically connected to the second voltage $V_{EE}$. Specifically, the first end of the micro LED 231 is connected to the second end of the driving transistor 221, and the first end of the micro LED 232 is connected to the second end of the driving transistor 222. Accordingly, the selection driving unit 22 can control one of the micro LEDs 231 and 232 to emit light according to the data signal $D_j$ transmitted through the switch unit 21. In other words, the selection driving unit 22 can select to conduct one of the driving transistors 221 and 222 according to the data signal $D_j$ transmitted through the switch unit 21, thereby enabling the micro LED 231 or 232, which is connected to the conducted driving transistor, to emit light.

In more detailed, in this embodiment, when the switch transistor 211 is conducted based on the scan signal $S_i$ transmitted through the scan line, the data signal $D_j$ can be transmitted to the control ends of the driving transistors 221 and 222 of the selection driving unit 22 through the data line and the switch transistor 211. Then, either the driving transistor 221 or the driving transistor 222 can be conducted based on the data signal $D_j$. For example, when the data signal $D_j$ is in the low level (0, or negative bias), the driving transistor 221 can be conducted, so that the first voltage $V_{DD}$ can be transmitted to the corresponding connected micro LED 231 through the driving transistor 221, thereby forming the voltage difference between two ends of the micro LED 231 so as to drive the micro LED 231 to emit. Meanwhile, the micro LED 232 is not turned on. In addition, when the data signal is $D_j$ is in the high level (1, or positive bias), the driving transistor 222 can be conducted, so that the first voltage $V_{DD}$ can be transmitted to the corresponding connected micro LED 232 through the driving transistor 222, thereby forming the voltage difference between two ends of the micro LED 232 so as to drive the micro LED 232. Meanwhile, the micro LED 231 is not turned on.

Accordingly, after the inspection-process of the finished micro LED display device 1 (e.g. the micro LED 232) and finding out the abnormal micro LED(s) of one (or some) of the sub-pixels (cannot be turned on), the micro LED display device 1 can be repaired by switching to turn on the other LED(s) of one (or some) of the sub-pixels. For example, when the micro LED 232, which is connected to the driving transistor 222 of the selection driving unit 22, is not turned on, the data signal $D_j$ transmitted to this sub-pixel is used to select to conduct the other driving transistor (e.g. the driving transistor 221), thereby turning on the other micro LED (e.g. the micro LED 231) connected to the currently conducted driving transistor (e.g. the driving transistor 221). As a result, the micro LED display device 1 of this disclosure can achieve the repairing of the micro LED of the abnormal sub-pixel(s) without the post-process of modifying the sub-pixel (sub-pixel circuit).

For example, as shown in FIGS. 2B and 2C, during the turn-on test, when the data signals $D_1$, $D_2$, $D_3$ are all in the high level (1) for conducting the N-type transistors (e.g. the driving transistors 222) of the corresponding sub-pixels, the micro LEDs (i.e. the micro LEDs 232) of all sub-pixels correspondingly connected to the N-type transistors can be normally turned on. This test result indicates that the micro LED display device is a good product without any abnormal sub-pixel.

However, as shown in FIGS. 2D and 2E, during the turn-on test, the micro LEDs (i.e. the micro LEDs 232) of the sub-pixels $P_{12}$, $P_{23}$, $P_{33}$ correspondingly connected to the N-type transistors (the driving transistors 222) cannot be turned on. In this case, when the scan signal $S_1$ transmitted from the scan line conducts the switch transistors 211 of the first row of sub-pixels $P_{11}$, $P_{12}$, $P_{13}$, the data signals $D_1$, $D_2$, $D_3$ transmitted from the data lines are changed to a high level (1), a low level (0), and a high level (1), thereby correspondingly conducting the N-type transistor (the driving transistor 222) of the sub-pixel $P_{11}$, the P-type transistor (the driving transistor 221) of the sub-pixel $P_{12}$, and the N-type transistor (the driving transistor 222) of the sub-pixel $P_{13}$. Accordingly, the micro LED 232 of the sub-pixel $P_{11}$, the micro LED 231 of the sub-pixel $P_{12}$, and the micro LED 232 of the sub-pixel $P_{13}$ are turned on, thereby repairing the abnormal sub-pixel $P_{12}$.

In addition, when the scan signal $S_2$ transmitted from the scan line conducts the switch transistors 211 of the second row of sub-pixels $P_{21}$, $P_{22}$, $P_{23}$, the data signals $D_1$, $D_2$, $D_3$ transmitted from the data lines are changed to a high level (1), a high level (1), and a low level (0), thereby correspondingly conducting the N-type transistor (the driving transistor 222) of the sub-pixel $P_{21}$, the N-type transistor (the driving transistor 222) of the sub-pixel $P_{22}$, and the P-type transistor (the driving transistor 221) of the sub-pixel $P_{23}$. Accordingly, the micro LED 232 of the sub-pixel $P_{21}$, the micro LED 232 of the sub-pixel $P_{22}$, and the micro LED 231 of the sub-pixel $P_{23}$ are turned on, thereby repairing the abnormal sub-pixel $P_{23}$.

Moreover, when the scan signal $S_3$ transmitted from the scan line conducts the switch transistors 211 of the third row of sub-pixels $P_{31}$, $P_{32}$, $P_{33}$, the data signals $D_1$, $D_2$, $D_3$ transmitted from the data lines are changed to a high level (1), a high level (1), and a low level (0), thereby correspondingly conducting the N-type transistor (the driving transistor 222) of the sub-pixel $P_{31}$, the N-type transistor (the driving transistor 222) of the sub-pixel $P_{32}$, and the P-type transistor (the driving transistor 221) of the sub-pixel $P_{33}$. Accordingly, the micro LED 232 of the sub-pixel $P_{31}$, the micro LED 232 of the sub-pixel $P_{32}$, and the micro LED 231 of the sub-pixel $P_{33}$ are turned on, thereby repairing the abnormal sub-pixel $P_{33}$.

As mentioned above, this disclosure does not utilize the conventional post-process to modify the sub-pixel circuit of the abnormal sub-pixel for repairing, but provides the proper data signals to the abnormal sub-pixel for controlling the selection driving unit 22 to select so as to repair the abnormal sub-pixel of the micro LED display device.

Figure 3A:
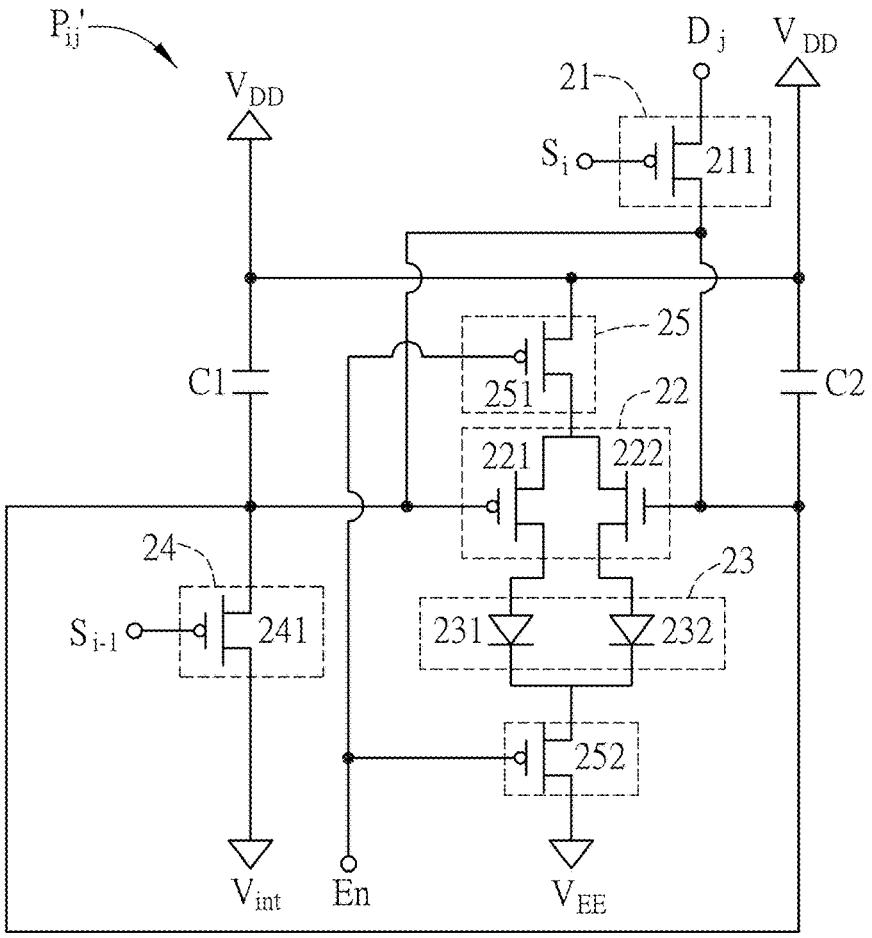
FIG. 3A is a schematic diagram showing another circuit of the sub-pixel in the micro LED display device of FIG. 1.
Figure 3B:
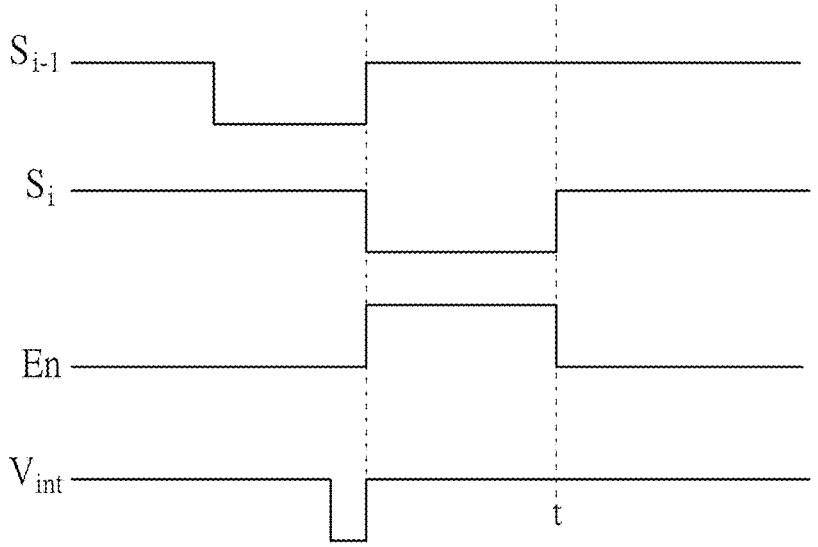
FIG. 3B is a schematic graph showing the waveforms of the signals for the sub-pixel of FIG. 3A.

FIG. 3A is a schematic diagram showing another circuit of the sub-pixel in the micro LED display device of FIG. 1, and FIG. 3B is a schematic graph showing the waveforms of the signals for the sub-pixel of FIG. 3A. In this embodiment, the sub-pixel $P_{ij}$ of FIG. 3A is a 6T2C circuit structure.

As shown in FIG. 3A, different from the sub-pixel $P_{ij}$ (the sub-pixel circuit) of the previous embodiment, the sub-pixel $P_{ij}'$ (the sub-pixel circuit) of this embodiment further comprises a reset unit 24 and an enable unit 25. In addition, the control ends of the driving transistors 221 and 222 of the selection driving unit 22 are electrically connected to the first voltage $V_{DD}$ through the corresponding capacitors C1 and C2.

The reset unit 24 comprises at least one reset transistor 241. The first end of the reset transistor 241 is connected to the control ends of the driving transistors 221 and 222, and the second end of the reset transistor 241 is electrically connected to a reset voltage $V_{int}$. The control end of the reset transistor 241 is connected to a previous scan signal $S_{i-1}$, so that the reset transistor 241 can be controlled by the scan signal $S_{i-1}$. In this embodiment, the reset voltage $V_{int}$ can be, for example but not limited to, a ground voltage (0V). In addition, the reset transistor 241 of this embodiment is, for example, an N-type transistor, but this disclosure is not limited thereto. In other embodiments, the reset transistor 241 can be a P-type transistor. In some embodiments, the sub-pixel $P_{ij}'$ may comprise two reset transistors 241, which can be two N-type transistors, two P-type transistors, or one N-type transistor and one P-type transistor, and this disclosure is not limited.

As shown in FIGS. 3A and 3B, when the sub-pixel $P_{(i-1)j}$ is driven by the scan signal $S_{i-1}$ and then conducted (i.e. the switch transistor 211 is conducted), the scan signal $S_{i-1}$ can also conduct the reset transistor 241 of the sub-pixel $P_{ij}$. Accordingly, the residual voltages of the control ends of the driving transistors 221 and 222 of the sub-pixel $P_{ij}$ can be released through the reset transistor 241. In other words, the control ends of the driving transistors 221 and 222 of the sub-pixel $P_{ij}$ can be reset by conducting the reset transistor 241. Afterwards, when the scan signal $S_i$ is provided to drive the sub-pixel $P_{ij}$, since the control ends of the driving transistors 221 and 222 of the sub-pixel $P_{ij}$ have been reset, the conducted driving transistor (221 or 222) can precisely control the brightness of the correspondingly connected micro LED (231 or 232), thereby achieving the goal of precisely controlling the brightness of the light-emitting unit.

Referring to FIG. 3A, the enable unit 25 comprises a first enable transistor 251 and a second enable transistor 252. Each of the first enable transistor 251 and the second enable transistor 252 comprises a control end, a first end and a second end. The control ends of the first enable transistor 251 and the second enable transistor 252 are connected to each other and controlled by an enable signal En. The first end of the first enable transistor 251 is electrically connected to the first voltage $V_{DD}$, and the second end of the first enable transistor 251 is connected to the first ends of the driving transistors 221 and 222. The first end of the second enable transistor 252 is connected to the second ends of the micro LEDs 231 and 232, and the second end of the second enable transistor 252 is electrically connected to the second voltage $V_{EE}$. In this embodiment, the first enable transistor 251 and the second enable transistor 252 are, for example, N-type transistors, but this disclosure is not limited thereto. In some embodiments, the first enable transistor 251 and the second enable transistor 252 can be P-type transistors, or one N-type transistor and one P-type transistor.

As shown in FIGS. 3A and 3B, in the sub-pixel $P_{ij}'$, when the scan signal $S_i$ controls to turn off the switch unit 21, and the enable signal En controls to conduct the first enable transistor 251 and the second enable transistor 252 (e.g. after the time t), the first voltage $V_{DD}$ and the second voltage $V_{EE}$ transmitted through the first enable transistor 251 and the second enable transistor 252 can control the micro LEDs, which connect to the conducted driving transistors, to emit light. Specifically, when the scan signal $S_i$ conducts the switch transistor 211, the first enable transistor 251 and the second enable transistor 252 will be cut off. After the scan signal $S_i$ controls to cut off the switch transistor 211 (after the time t), the enable signal En will conduct the first enable transistor 251 and the second enable transistor 252, thereby generating a voltage difference between two ends of the micro LED connected to the conducted driving transistor and thus controlling the micro LED to emit light.

To be noted, the other technical contents of the sub-pixel $P_{ij}'$ can be referred to the same components of the above-mentioned sub-pixel $P_{ij}$, so the detailed descriptions thereof will be omitted.

Figure 4:
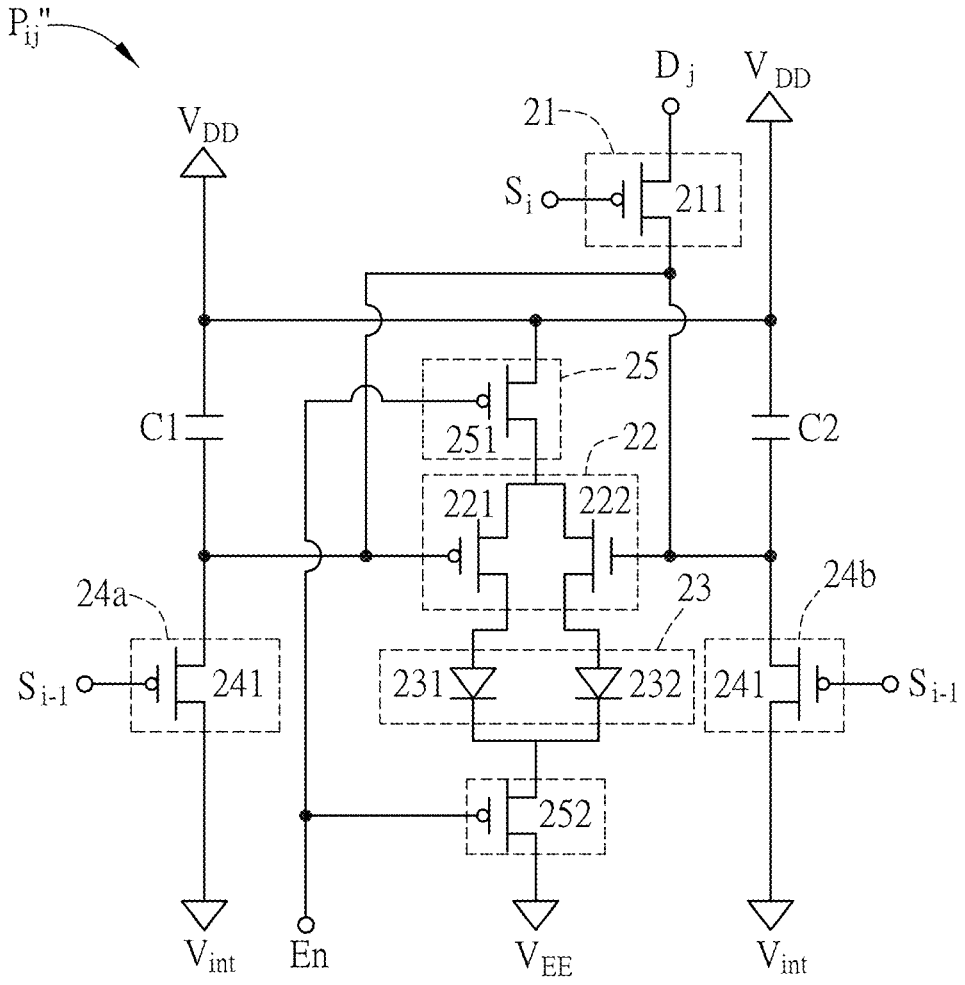
FIG. 4 is a schematic diagram showing another circuit of the sub-pixel in the micro LED display device of FIG. 1.

FIG. 4 is a schematic diagram showing another circuit of the sub-pixel in the micro LED display device of FIG. 1.

As shown in FIG. 4, different from the sub-pixel $P_{ij}'$ (the sub-pixel circuit) of the previous embodiment of the FIG. 3A, the sub-pixel $P_{ij}''$ (the sub-pixel circuit) of this embodiment comprises two reset units 24*a* and 24*b*. The first end of the reset transistor 241 of the reset unit 24*a* is connected to the control ends of the driving transistors 221 and 222, and electrically connected to the first voltage $V_{DD}$ through the capacitor C1. The first end of the reset transistor 241 of the reset unit 24*b* is connected to the control ends of the driving transistors 221 and 222, and electrically connected to the first voltage $V_{DD}$ through the capacitor C2. Since the reset units 24*a* and 24*b* are electrically connected to the first voltage $V_{DD}$ through the corresponding capacitors C1 and C2, respectively, the functions of the reset units 24*a* and 24*b* will not interfere to each other in the case when the capacitors C1 and C2 exist errors, which may be caused by the non-equal voltage differences of two ends of the capacitors C1 and C2 due to the manufacturing processes and circuits.

To be noted, the other technical contents of the sub-pixel $P_{ij}''$ can be referred to the same components of the above-mentioned sub-pixel $P_{ij}$ or $P_{ij}'$, so the detailed descriptions thereof will be omitted.

In summary, in the micro LED display device and the sub-pixel circuit thereof of this disclosure, the selection driving unit is electrically connected to the first voltage, the first ends of two micro LEDs of the light-emitting unit are connected to the selection driving unit, the second ends of the micro LEDs are electrically connected to the second voltage, and the selection driving unit selects one of the micro LEDs to emit light according to the data signal transmitted through the switch unit. Based on the circuit design of this disclosure, the micro LEDs of the abnormal sub-pixels can be repaired without utilizing the convention post-process to modify the sub-pixel circuits.

Although the disclosure has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the disclosure.

What is claimed is:

1. A sub-pixel circuit of a micro light-emitting diode display device, comprising:

a switch unit receiving a data signal;

a selection driving unit electrically connected to the switch unit, wherein the selection driving unit is electrically connected to a first voltage; and a light-emitting unit comprising two micro light-emitting diodes, wherein the two micro light-emitting diodes are electrically connected to the selection driving unit individually, each of the two micro light-emitting diodes comprises a first end and a second end, the first ends of the micro light-emitting diodes are electrically connected to the selection driving unit, and the second ends of the micro light-emitting diodes are electrically connected to a second voltage;

wherein, the selection driving unit comprises two driving transistors, the driving transistors are disposed corresponding to and connected to the micro light-emitting diodes respectively, each of the driving transistors comprises a control end so as to receive the data signal from the switch unit, the selection driving unit selects one of the micro light-emitting diodes to emit light according to the data signal.

2. The sub-pixel circuit of claim 1, wherein the selection driving unit selects one of the driving transistor to turn on according to the data signal so as to drive the micro light-emitting diode connected to the conducted driving transistor to emit light.

3. The sub-pixel circuit of claim 1, wherein the driving transistors comprise a P-type transistor and an N-type transistor.

4. The sub-pixel circuit of claim 1, wherein each of the driving transistors further comprises a first end and a second end, the control ends of the driving transistors are connected to each other and electrically connected to the switch unit, the first ends of the driving transistors are electrically connected to the first voltage, and the second ends of the driving transistors are electrically connected to the first ends of the micro light-emitting diodes, respectively.

5. The sub-pixel circuit of claim 4, wherein the switch unit comprises a switch transistor, a control end of the switch transistor is connected to a scan line for receiving a scan signal, a first end of the switch transistor is connected to a data line for receiving the data signal, and a second end of the switch transistor is connected to the control ends of the driving transistors.

6. The sub-pixel circuit of claim 1, further comprising:

a reset unit comprising at least a reset transistor, wherein a first end of the reset transistor is connected to the control ends of the driving transistors, and a second end of the reset transistor is electrically connected to a reset voltage.

7. The sub-pixel circuit of claim 4, further comprising:

an enable unit comprising a first enable transistor and a second enable transistor, wherein each of the first enable transistor and the second enable transistor comprises a control end, a first end and a second end, the control ends of the first enable transistor and the second enable transistor are connected to each other and receive an enable signal, the first end of the first enable transistor is electrically connected to the first voltage, the second end of the first enable transistor is connected to the first ends of the driving transistors, the first end of the second enable transistor is connected to the second ends of the micro light-emitting diodes, and the second end of the second enable transistor is electrically connected to the second voltage.

8. The sub-pixel circuit of claim 7, wherein when the enable signal conducts the first enable transistor and the second enable transistor, the micro light-emitting diode connected to the conducted driving transistor emits light.

9. A micro light-emitting diode display device, comprising:

a display panel comprising a plurality of sub-pixels, wherein the sub-pixels are arranged in an array including rows and columns, each of the sub-pixels comprises a sub-pixel circuit, and the sub-pixel circuit comprises:

a switch unit receiving a data signal;

a selection driving unit electrically connected to the switch unit, wherein the selection driving unit is electrically connected to a first voltage; and a light-emitting unit comprising two micro light-emitting diodes, wherein the two micro light-emitting diodes are electrically connected to the selection driving unit individually, each of the two micro light-emitting diodes comprises a first end and a second end, the first ends of the micro light-emitting diodes are electrically connected to the selection driving unit, and the second ends of the micro light-emitting diodes are electrically connected to a second voltage;

wherein, the selection driving unit comprises two driving transistors, the driving transistors are disposed corresponding to and connected to the micro light-emitting diodes respectively, each of the driving transistors comprises a control end so as to receive the data signal from the switch unit, the selection driving unit selects one of the micro light-emitting diodes to emit light according to the data signal.

10. The micro light-emitting diode display device of claim 9, wherein the selection driving unit selects one of the driving transistor according to the data signal so as to drive the micro light-emitting diode connected to the conducted driving transistor to emit light.

11. The micro light-emitting diode display device of claim 9, wherein the driving transistors comprises a P-type transistor and an N-type transistor.

12. The micro light-emitting diode display device of claim 9, wherein each of the driving transistors further comprises a first end and a second end, the control ends of the driving transistors are connected to each other and electrically connected to the switch unit, the first ends of the driving transistors are electrically connected to the first voltage, and the second ends of the driving transistors are electrically connected to the first ends of the micro light-emitting diodes respectively.

13. The micro light-emitting diode display device of claim 12, wherein the switch unit comprises a switch transistor, a control end of the switch transistor is connected to a scan line for receiving a scan signal, a first end of the switch transistor is connected to a data line for receiving the data signal, and a second end of the switch transistor is connected to the control ends of the driving transistors.

14. The micro light-emitting diode display device of claim 9, wherein the sub-pixel circuit further comprises a reset unit, the reset unit comprises at least one reset transistor, a first end of the reset transistor is connected to the control ends of the driving transistors, and a second end of the reset transistor is electrically connected to a reset voltage.

15. The micro light-emitting diode display device of claim 12, wherein the sub-pixel circuit further comprises an enable unit, the enable unit comprises a first enable transistor and a second enable transistor, each of the first enable transistor and the second enable transistor comprises a control end, a first end and a second end, the control ends of the first enable transistor and the second enable transistor are connected to each other and receive an enable signal, the first end of the first enable transistor is electrically connected to the first voltage, the second end of the first enable transistor is connected to the first ends of the driving transistors, the first end of the second enable transistor is connected to the second ends of the micro light-emitting diodes, and the second end of the second enable transistor is electrically connected to the second voltage.

16. The micro light-emitting diode display device of claim 15, wherein when the enable signal conducts the first enable transistor and the second enable transistor, the micro light-emitting diode connected to the conducted driving transistor emits light.

17. The micro light-emitting diode display device of claim 9, further comprising:

a data driving circuit electrically connected to the display panel through a plurality of data lines, wherein the data driving circuit transmits the data signal to the sub-pixel circuits through the data lines; and a scan driving circuit electrically connected to the display panel through a plurality of scan lines, wherein the scan driving circuit transmits a scan signal to the sub-pixel circuits through the scan lines.

* * * * *